United States Patent [19]

Roosa et al.

[11] Patent Number: 4,844,330

[45] Date of Patent: Jul. 4, 1989

[54] PAPERBOARD FOOD CARTON AND DIVIDER

[75] Inventors: Paul D. Roosa, Saugerties; Robert L. Gordon, Monroe; Barbara Mesquida, Forest Hills, all of N.Y.

[73] Assignee: International Paper Company, Purchase, N.Y.

[21] Appl. No.: 826,693

[22] Filed: Feb. 6, 1986

[51] Int. Cl.[4] ..... B65D 5/22

[52] U.S. Cl. ..... 229/120.06; 229/902; 206/568; 220/22; 426/115

[58] Field of Search ..... 229/33, 15, 27, 902, 229/DIG. 13, DIG. 10, 120.02, 120.03, 120.04, 120.06; 206/568; 220/4 B, 4 E, 22

[56] References Cited

U.S. PATENT DOCUMENTS

| | | | |
|---|---|---|---|
| 981,744 | 3/1911 | Bowditch | 206/499 |
| 1,319,024 | 10/1919 | Warfield | 220/345 |
| 2,072,753 | 3/1937 | Ikeda et al. | 229/36 |
| 2,141,743 | 12/1938 | Ethridge | 206/45.11 |
| 2,141,752 | 12/1938 | Hoarle | 229/44 |
| 2,468,543 | 4/1949 | Chalmers | 229/16 |
| 2,510,211 | 6/1950 | Cleary | 206/219 |
| 2,579,354 | 12/1951 | Zelt | 220/60 |
| 2,839,236 | 6/1958 | Dunning | 229/45 |
| 2,852,177 | 9/1958 | Frasch | 229/15 |
| 2,887,389 | 5/1959 | Linville | 206/526 |
| 3,008,625 | 11/1961 | Cook | 229/23 |
| 3,288,349 | 11/1966 | Palmer et al. | 229/39 |
| 3,511,433 | 5/1970 | Andrews et al. | 229/44 R |
| 3,799,409 | 3/1974 | Goerke | 222/561 |
| 3,888,407 | 6/1975 | Davies | 229/44 CB |
| 3,933,296 | 1/1976 | Ruskin et al. | 229/2.5 R |
| 3,949,931 | 4/1976 | Hall | 229/36 |
| 3,968,922 | 7/1976 | Ruud | 229/33 |
| 4,136,816 | 1/1979 | Gardner et al. | 229/33 |
| 4,226,358 | 9/1980 | Ottow | 229/44 R |
| 4,232,816 | 11/1980 | Johnson | 229/33 |
| 4,241,863 | 12/1980 | Faller | 229/27 |
| 4,266,713 | 5/1981 | Maroszek | 229/33 |
| 4,339,068 | 7/1982 | Brauner | 229/33 |

FOREIGN PATENT DOCUMENTS 642233 5/1964 Belgium .

*Primary Examiner*—Willis Little

*Attorney, Agent, or Firm*—Walt Thomas Zielinski

[57] ABSTRACT

A clamshell or other hinged top cover type carton for hamburgers is provided with a divider sheet formed from paperboard or a paperboard laminate. The ends of the divider sheet extend laterally beyond the side edges of the carton. A bun heel and hot hamburger patty are located in the lower half of the container and a bun crown and various toppings are located in the top container half. The divider sheet separates the hot meat patty from the cooler toppings. For hamburger consumption, the user pulls a laterally extending edge of the divider sheet laterally away from the carton, the bun crown and toppings fall on to the hot hamburger patty and bun heel, thereby preparing the hamburger sandwich. The consumer now opens the carton to gain access to the sandwich.

7 Claims, 7 Drawing Sheets

PAPERBOARD FOOD CARTON AND DIVIDER

BACKGROUND OF THE INVENTION

This invention relates to a paperboard food carton formed from a unitary paperboard blank, the carton being of the type having a hinged top or cover. Many food products, such as hamburgers and the like are packaged in paperboard cartons and sold by so-called fast food restaurants. In the case of hot sandwiches with condiments (roast beef, corned beef, hamburger, turkey and the like) the personnel at the fast food restaurant may place a lower bread bun in the bottom tray or bottom half of the opened carton. A hot hamburger patty is then placed on top of the lower bun. Usually, toppings or condiments such as diced onions, onion slices, tomato slices, lettuce, pickle slices, etc. are placed on top of the patty, the upper bread bun placed on top of the toppings and the carton closed. Alternatively, the hamburger may be completely made, with the toppings, and then placed in the food carton. The carton is then either immediately handed to the customer, or the carton may be placed in a holding storage rack, or placed within a larger container such as a bag in those cases wherein the customer orders the food product through a so-called drive-thru window in the fast food restaurant.

Particularly in those cases wherein the hamburger and carton which contain it are placed in a storage area, or are placed in a larger container which is adapted to carry other food products, such as french fries and soft drinks, there can exist an appreciable length of time between the making of the hamburger and the opening of the carton and consumption of the hamburger by the customer. This length of time results in a cooling of the hamburger and warming of the condiments making them soggy. This cooling and warming effect is accelerated by the intimate, touching contact of the top of the hot hamburger with the toppings, the toppings usually being at ambient temperature or lower. Thus, as soon as the toppings are put on the hot hamburger, there is an immediate transfer of heat from the hot hamburger to the toppings, thereby diminishing the temperature and the taste quality of the hamburger and changing the texture of either the hamburger, roast beef, or other primary meat product, or the texture of the condiments, or both.

SUMMARY OF THE INVENTION

According to the practice of this invention, a hinged hamburger container or carton is provided with a divider sheet, the sheet preferably being formed of paperboard or a paperboard laminate, such as paperboard coated with polyethylene. The divider sheet is located above the hot hamburger patty and its bun heel, with the divider sheet being wider than the widest portion between the junction of the upper and lower hinged portions of the paperboard container. Then, the various toppings and bun crown are located on top of the divider sheet, and the upper container portion hinged downwardly and latched to the lower container portion to thereby lock the two container portions together for subsequent dispensing to the customer. In use, the customer grasps one of the two laterally extending edges of the sheet divider, pulls it laterally away from the container, to thereby permit the toppings and bun crown to fall onto the hot hamburger patty. This is done by the consumer immediately prior to opening the carton. By virtue of the use of the divider panel, the rate of cooling of the hot hamburger patty and warming of the condiments are appreciably diminished, thereby maintaining them at the original preparation temperature for a longer period of time than would otherwise be the case, i.e., the case wherein the toppings are immediately placed in intimate, physical contact with the hot patty when the hamburger is made prior to its insertion into the container.

The full nature of the invention will be understood from the accompanying drawings and the following description and claims. It should be understood, however, that references in the following description to front, rear, and side walls and the like are for the convenience of the reader in following the description, and such terms are not intended to be used in a limiting sense.

DETAILED DESCRIPTION OF THE INVENTION

Figure 1:
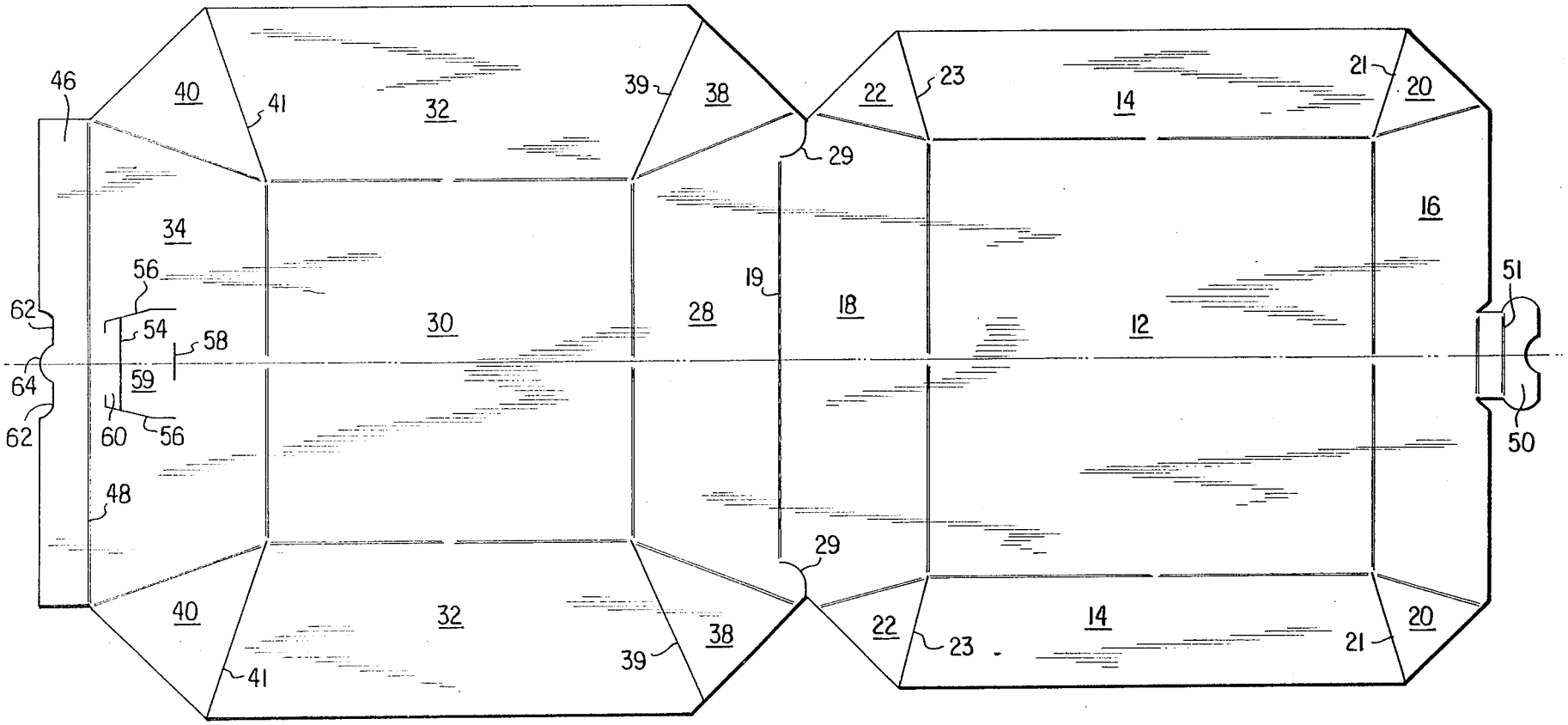
FIG. 1 is a plan view of a cut and scored paperboard blank for forming the carton of this invention.

Referring now to FIG. 1 of the drawings, the numeral 10 denotes a blank of sheet material which is stiff, resilient and foldable, such as paperboard or paperboard coated with a grease resistant coating of plastics material such as polyethylene, as is conventional in this art. When folded and assembled (as will be explained) the blank of FIG. 1 forms a carton of the so-called clamshell type, such as illustrated in U.S. Pat. No. 4,232,816 issued to Johnson et al, hereby incorporated by reference. While illustrated in connection with a clamshell type carton, the invention may be used with any carton having a hinged or folding top or cover. The numeral 12 denotes the central bottom wall or panel of the upper half of the carton, while numerals 14 denote side panel portions integrally formed therewith, with numeral 16 denoting an upper front bottom wall and numeral **18*c* an upper bottom rear wall. The numerals 20 and 22 denote triangular tabs separated from bottom side panels 14 by cuts 21 and 23 respectively, the tabs adapted to cooperate with the side, front and rear walls to form a generally truncated, four-sided pyramid shape. The numeral 28 denotes the rear end wall of the top half of the carton, integrally connected to central top wall forming panel 30. Upper side walls 32 are foldably connected as indicated to panel 30, with numeral 34 denoting the top container half front wall. The numerals 38 and 40 denote triangular tabs integral, respectively, with panels 28 and 34 and separated from top side panels 32 by cuts 39 and 41** respectively.

The numeral 19 denotes a hinge line between rear panels 18 and 28, the end of this hinge line meeting cut, radiused portions 29, the latter integral with panel 28. The numeral 46 denotes an end panel integrally formed with panel 34 and joined to it by hinge line 48. The numeral 50 denotes a tab or tongue integrally and foldably secured to panel 16 by two hinge lines, one of which is denoted by the numeral 51, and is adapted to cooperate with a recess in top front wall 34 to releasably latch the two container halves together. The tongue receiving recess is defined by cuts 54, 56 and 58 in panel 34. Panel 46 carries on one edge recesses 62 and projection 64, the shape of these being complementary to the endmost free edge of tab 50.

The blank 10 is thus defined by two halves each cut and foldable to form a tray, the two tray forming halves hinged together along axis 19, the latter being transverse to the longitudinal axis of the blank. Side panels 14 are of equal width, as are side panels 32. However, panels 14 are of a lesser width than panels 32. Panels 18 and 28 are of substantially the same width. End panel 16 is of a width lesser than that of opposite end panel 34. The direction of grain of the paperboard is parallel to the longitudinal axis of the blank.

Figure 2:
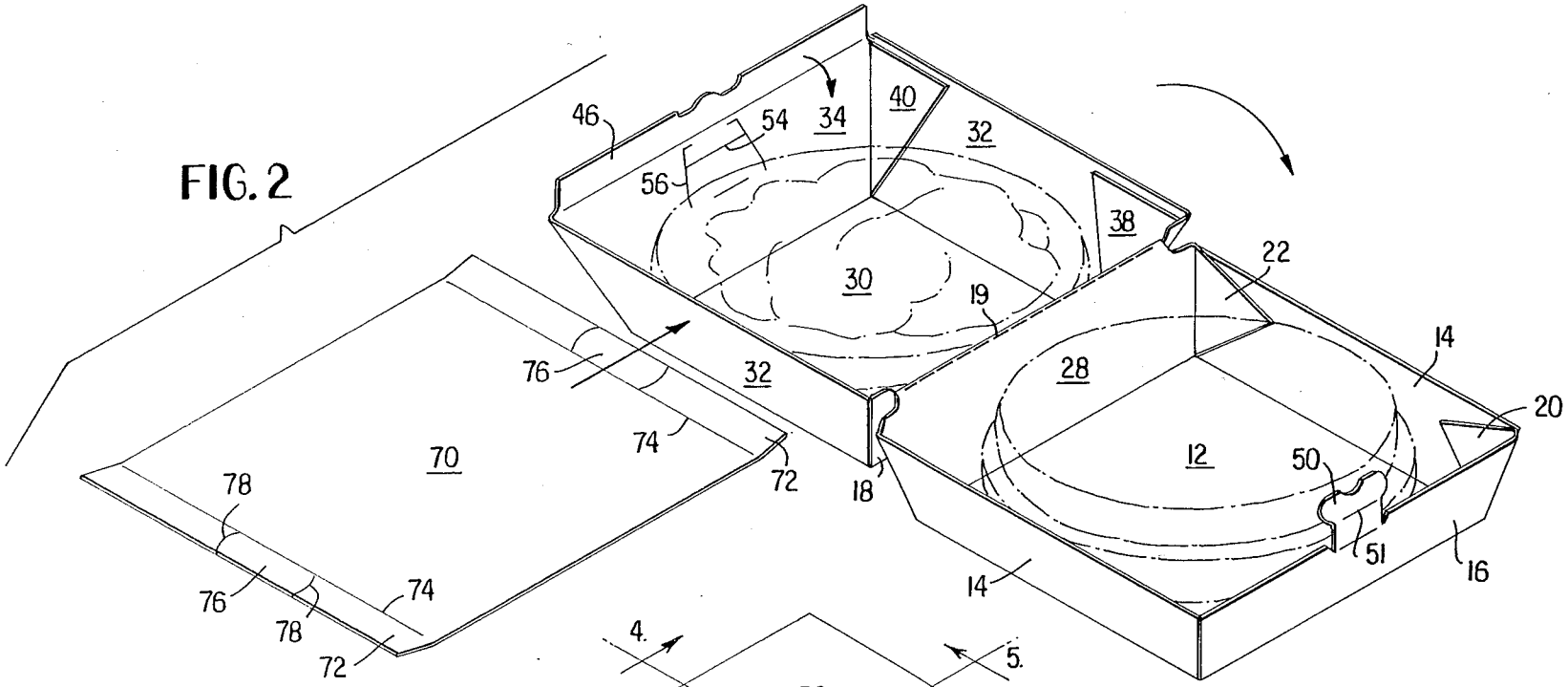
FIG. 2 is a perspective view of the blank of FIG. 1 when folded and glued to form a clamshell type carton the carton lying on a (not illustrated) flat surface, and also illustrates the divider sheet of this invention.

Referring now to FIG. 2 of the drawings, the blank of FIG. 1 has been folded and tabs 20, 22, 28 and 40 glued to associated side walls 14, 32, as is conventional in this art.

Still referring to FIG. 2, the numeral 70 denotes a divider sheet, preferably also formed from paperboard or paperboard coated with polyethylene or other thermoplastic material or any other grease resistant material. The plastic acts as a grease and moisture barrier and provides smooth surfaces so that the food product does not stick to it when the divider is pulled out. Divider sheet 70 is generally rectangular in form and includes opposite edge portions 72 integrally attached by virtue of fold lines 74. The numeral 76 denotes a tab formed in each edge portion 72 by cuts 78, these cuts forming the flexible tabs 76 which may be pulled, as will be described.

Figure 3:
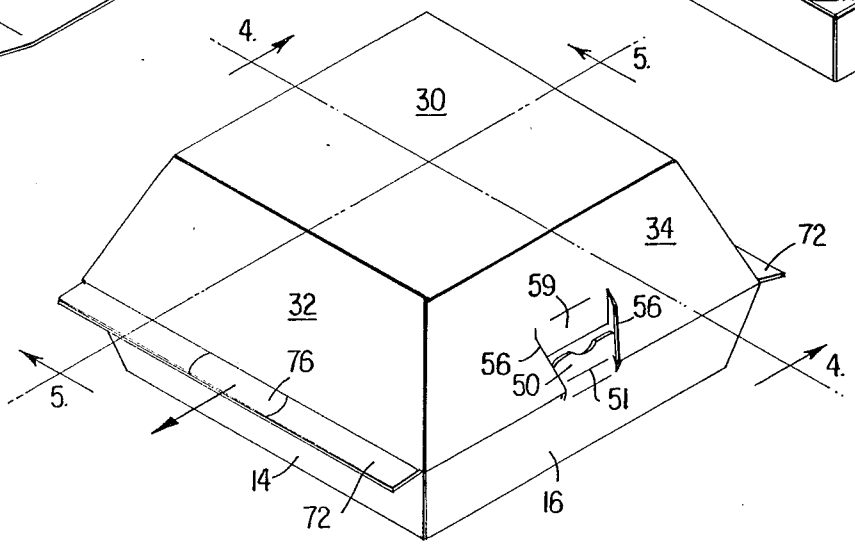
FIG. 3 is a perspective view of the closed container of FIG. 2, showing the sheet divider in place.
Figure 4:
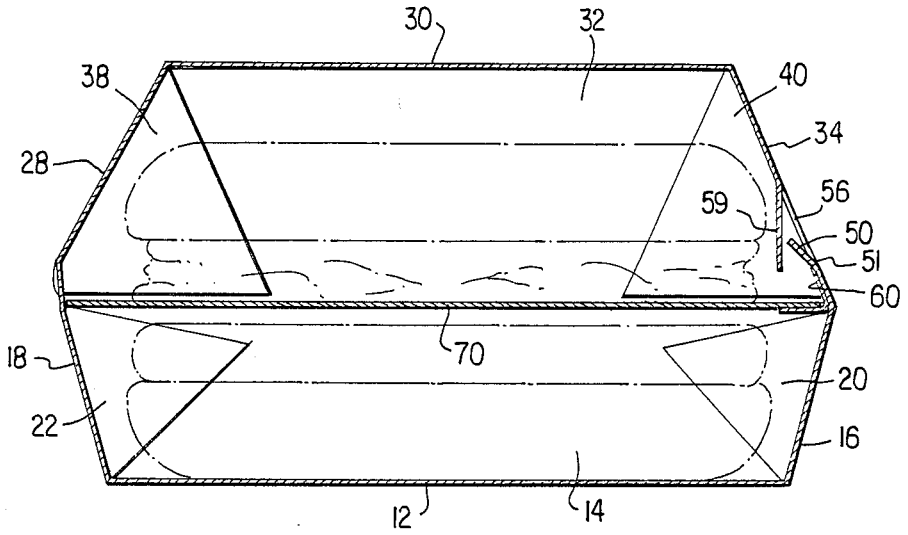
FIG. 4 is a cross-sectional view taken along section 4—4 of FIG. 3.

In use, a bread bun heel is placed in the bottom of the lower tray which includes bottom wall 12. Then, a hot hamburger patty is placed on the heel. At this time, as indicated by the phantom lines, bun crown or top is placed on surface 30. Condiments or toppings as desired by the consumer, such as onions, pickles, lettuce and the like are placed on top of the bread bun crown. Then divider panel 70 is placed on top of edges 32, with fold lines 74 resting on these edges to assist in locating and maintaining divider sheet 70 in place, as shown at FIG. 3. Flap 46 is now turned down, to clamp divider sheet 70 firmly in place. The packager now rotates the top of the container clockwise, holding flap 46 firmly, until the container is closed. Sheet 70 thus inhibits spilling out of the bun crown and the condiments. Tab 50 is now pushed against portion 59 of panel 34, the former hinging along cut line 58 to permit entry of tab 50, as indicated at FIG. 4. The lateral ends of tab 50 swing, as by a slight flexing of the tab, behind cuts 56, thus latching the container closed. Fold line 51 abuts edge 54 of latch portion 60, with tab 50 being bent as shown at FIG. 4. The completed food package is shown at FIG. 3 with the bottom tray, the top cover and divider sheet in place, and with the sandwich housed therein.

Figure 5:
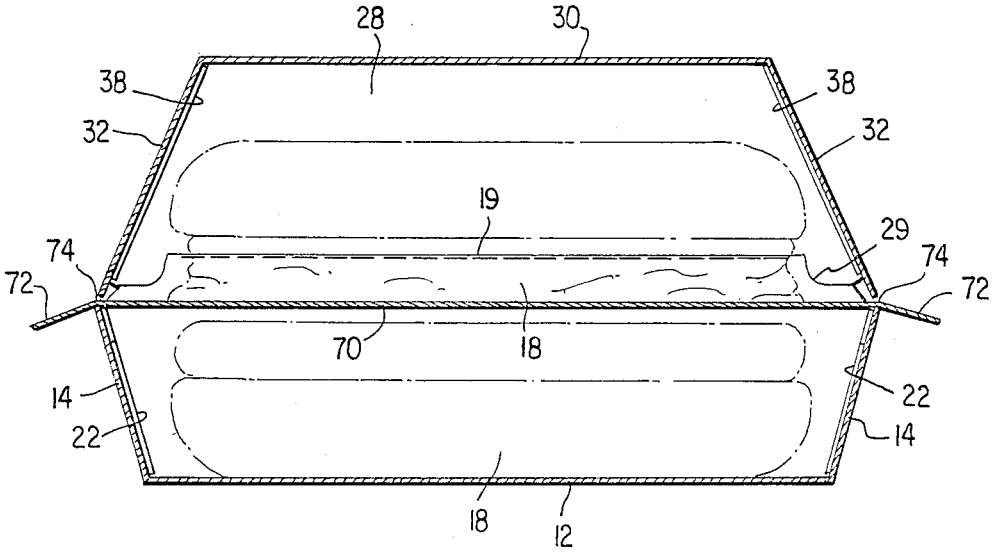
FIG. 5 is a cross-sectional view taken along section 5—5 of FIG. 3.

In use, the consumer, upon receiving the package shown at FIG. 3, pulls one of the edges 72 laterally, i.e., more or less parallel to panels 12 and 30, to thereby remove divider sheet 70. Conveniently, the user may grasp a tab 76 of panel 72. At this time, as may readily be seen by reference to FIGS. 4 and 5, the toppings 86, together with the bun crown fall upon the hot hamburger 82. The lower edges of side panels 14 are in pressure contact with divider 70. When divider sheet 70 is pulled out, top edges of side walls 14 wipe the divider clean, i.e., a squeegee action. The user now has only to pull out tongue 50 to open the carton to gain access to the hamburger.

The reader will readily visualize that the tabs 76 may be pulled to thereby remove divider panel 70 from the right or the left side.

From a consideration of the above description it will be apparent that the process and structure set out makes possible a lower carton half for the hot hamburger patty which is at least partially thermally isolated or insulated from the upper carton half which contains the relatively cooler toppings. The hamburger patty is not placed in direct, intimate physical contact with the toppings until the user of this carton assembly is ready to consume the hamburger. Again, while the description has described a hamburger patty as the main component of the sandwich, the invention is useful with other food products.

While described as particularly useful with a clamshell type carton, it is clear that other types of hinged cartons may be employed to practice the invention.

From a consideration of FIG. 2 it is apparent that flap 46 need not be employed as a part of the carton, this flap facilitating in maintaining the divider sheet 70 over the open end the upper carton half when folding the latter from its position in FIG. 2, with the bun crown and toppings thereon, to the final, closed carton configuration of FIG. 3. It will further be apparent that the completed food package of FIG. 3 may be formed in another manner. Namely, placing the divider sheet on top of the lower carton half, as shown at FIG. 2 with the bun heel and hot patty therein. The divider sheet may now be placed on the upper rims of panels 14 and toppings and the bun crown built on top of the divider panel. The upper carton half, being empty, is now swung over. In this other manner of formation, the flap 46 is not required. The construction and operation of the latching elements is the same. In either mode of food package formation, the carton construction is such that when opened, both the crown top panel 30 and the lower tray bottom panel 12 lie flat in the same plane, as indicated at FIG. 2.

Figure 6:
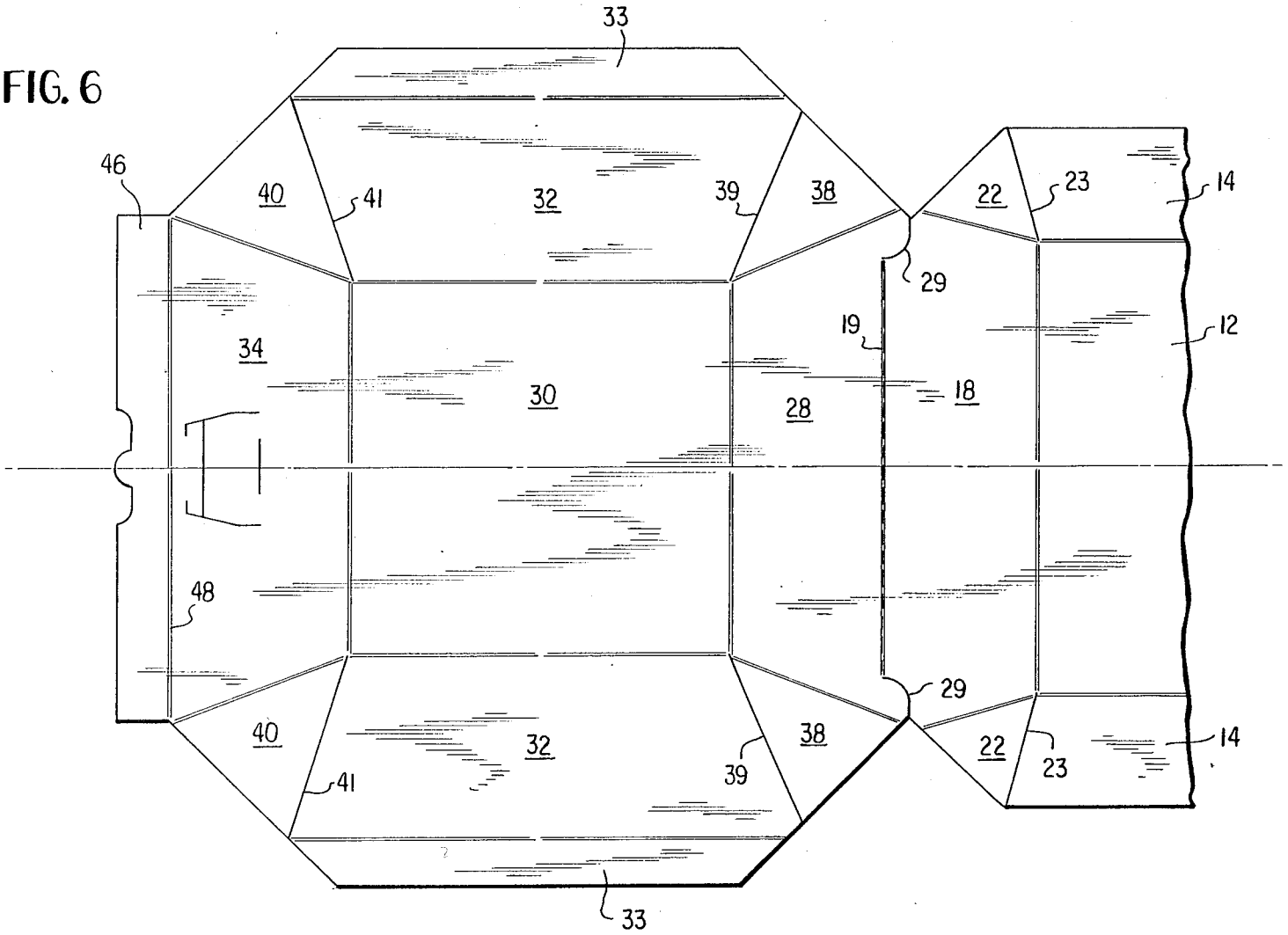
FIG. 6 is a partial plan view, similar to FIG. 1, and illustrates a second embodiment.
Figure 7:
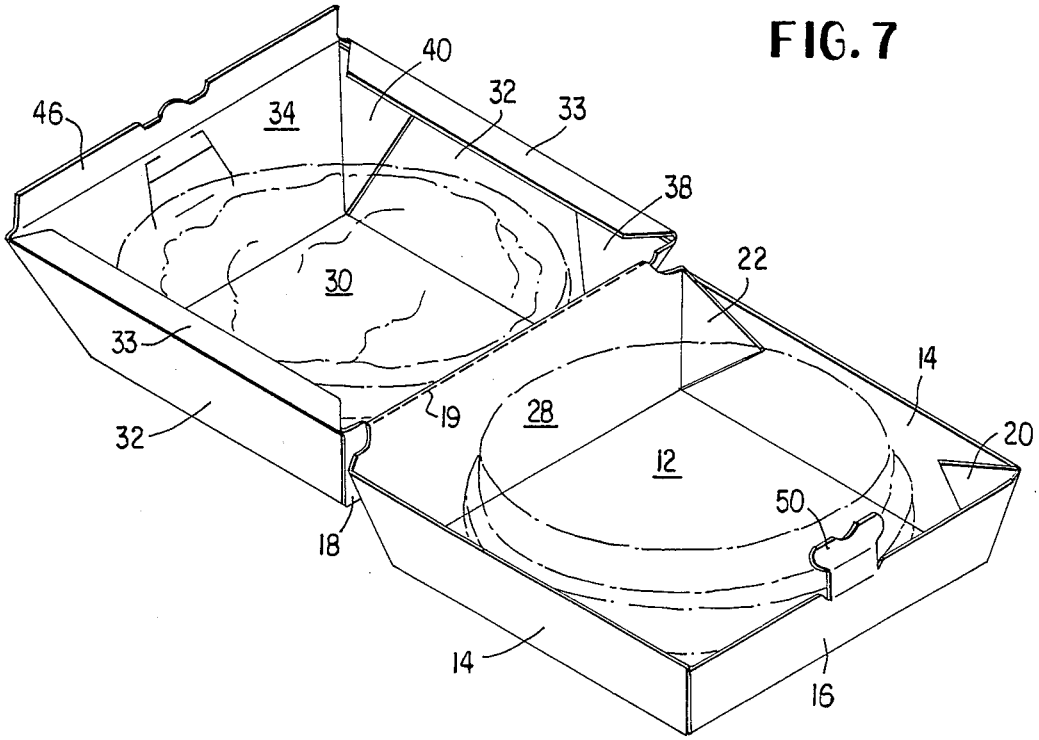
FIG. 7 is a view, similar to FIG. 2, of the second embodiment.
Figure 8:
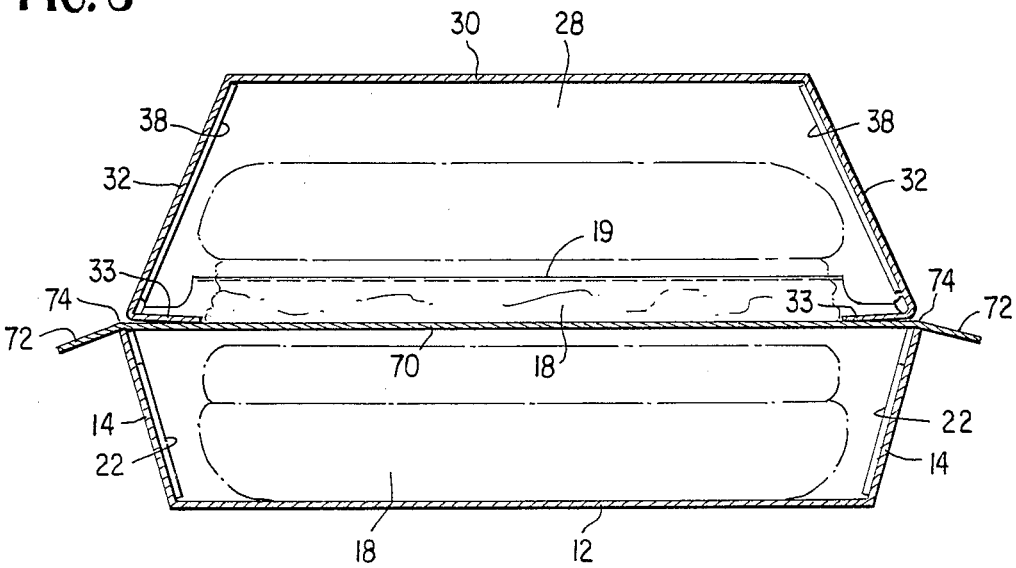
FIG. 8 is a cross sectional view, similar to FIG. 5, of the second embodiment.

Referring now to FIGS. 6,7 and 8, a second embodiment of the invention is illustrated. The blank is partially shown at FIG. 6, and is identical with the blank of FIG. 1, except for the addition of wiping panels 33 to the free edges of side panels 32 of the crown forming half of the container. The blank is folded, glued and erected in the same manner as previously described and illustrated. The fully open configuration is shown at FIG. 7, being similar to FIG. 2, as though panels 12 and 30 were resting one a common horizontal surface. The reader will note that wiping panels 33 fold toward the interior of the container crown. As shown at FIG. 8, being a view similar to FIG. 5, the wiping panels 33 rest on top of divider panel 70 in at least partial surface o surface contact. When divider panel 70 is pulled laterally from the closed container, the wiping panels assist in preventing condiments on top of the divider panel 70 from sticking to the panel to the panel 70. Further, the free edges of wiping panels 33 also inhibit lateral movement of condiments away from the food product upon lateral movement of the divider plate.

Figure 9:
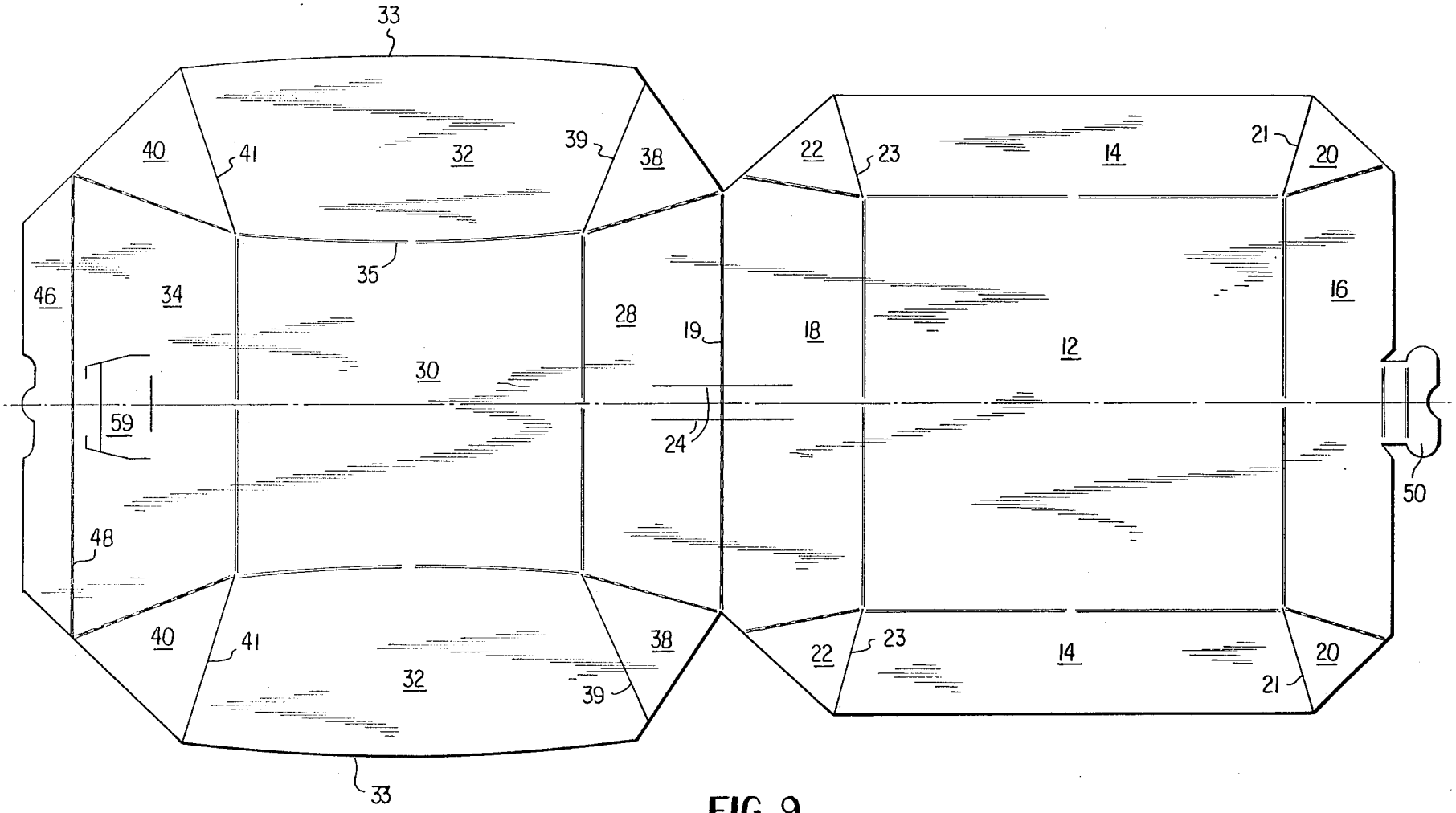
FIG. 9 is a plan view of the blank of a third modification of the invention.
Figure 10:
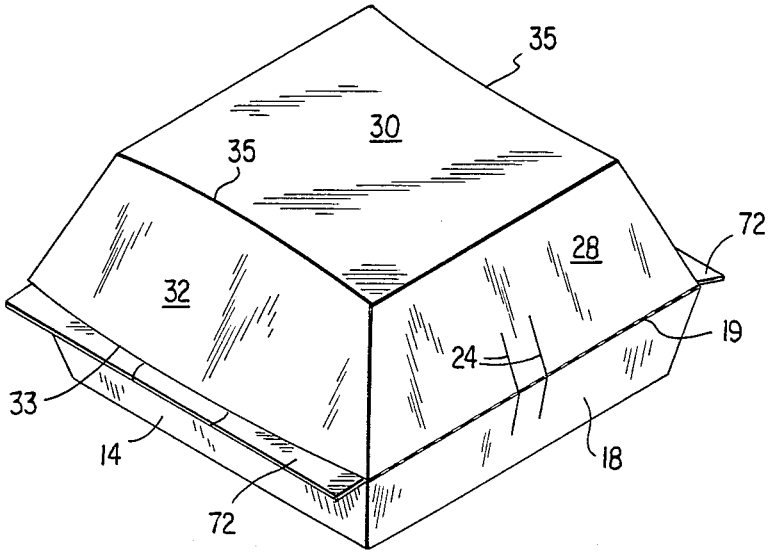
FIG. 10 is a perspective view, similar to FIG. 3, showing a closed container formed from the blank of FIG. 9.

Referring now to FIG. 9, a third blank is shown, formed of the same paperboard material as that of the previous embodiments, and folded in an entirely similar manner to form the container shown at FIG. 10. The blank of FIG. 9 differs substantially from that of FIG. 1 in the outward flaxing or convexity of the order, longitudinally extending, edges of panels 32. This arcuate edge is denoted by the numeral 33 in FIG. 9. In one example of the blank of FIG. 9, the midportion of arcuate edges 33 was about 0.94 inch from a chord joining the ends arcs 33, the chord being about 5.18 inches long. The radius of curvature of arcuate edges 33 was about 33.64 inches.

Additionally longitudinally extending fold or hinge lines 35 bordering panel 30 are bowed inwardly towards each other, while the corresponding fold lines on the other two embodiments are straight. Further, the ends of end panel 46 are slanted. Still further, longitudinally extending cuts 24, extending through the paperboard, intersect hinge axis 19. Finally, the radiused portions 29, present in the other embodiments, are not in the blank of FIG. 9.

FIG. 10 illustrates the assembled container fashioned from the blank of FIG. 9, having been folded and filled with a food product in a manner identical to that illustrated at FIG. 2.

In operation, the concave edges 35 of the crown or upper portion of the container serve to maintain the upper portion of the food product centrally of the crown when divider panel 70 is withdrawn by pulling either portion 72 of it. The convex or arcuate form of the free, lower edges 33 of side walls 32 yields a superior squeege or wiping action or divider panel 70 when the latter is withdrawn from the container, as has been previously described.

What is claimed is:

1. A food carton formed from a unitary blank of foldable paperboard comprising a bottom tray; a top cover, a hinge connecting said bottom tray to said top cover; and means on said bottom tray and said top cover to releasably latch and close said carton; said bottom tray comprising a base wall, a front wall, a rear wall; and a pair of side walls, each such wall hingedly connected to, and extending from said base wall; said top cover comprising a top wall; a front wall; a rear wall; and a pair of side walls, each such wall hingedly connected to and extending from said top wall; the rear wall of the bottom tray and the rear wall of the top cover being integrally joined by a said hinge, a separate divider sheet of relatively low thermal conductivity extending across and positioned on the upper end of the bottom tray and at least substantially closing it and the lower end of the top cover, the divider sheet having at least one finger-grippable portion extending laterally beyond the sides of the tray, whereby the finger-grippable portion can be grasped to pull the divider sheet laterally and uncover the upper end of the bottom tray while the carton is closed the divider sheet being of such length that two of its opposite ends extend laterally beyond the upper end of the bottom tray to thereby define two finger-grippable portions, and wherein the lower edge of at least one top cover side wall carries an integral wiping panel, said wiping panel being bent towards and extending into the interior of the food carton, one surface of said wiping panel being in at least partial surface to surface contact with the upper surface of said divider panel, whereby when the divider panel is moved laterally toward the wiper panel, the wiping action on the top surface of the divider panel is increased.

2. The food carton of claim 1 wherein the top cover and the bottom tray are each in the form of a truncated, four-sided pyramid, to thereby form a clamshell type carton.

3. The food carton of claim 1 wherein the depth of the upper half of the carton is greater than the depth of the lower carton half.

4. The food carton of claim 1 including a hot, first food product within the bottom tray and including a second food product, having a lower temperature than the first food product, in the top tray, the lower temperature food product lying on top of the divider sheet, whereby the first and second food product are separated from each other and are at least partially thermally isolated from each other, the distance between the free edges of the divider panel being greater than the diameter of the second food product.

5. A one piece blank of stiff, resilient and foldable material, such as paperboard, the blank having two halves each cut and foldable and erectable to form a tray, the two tray forming halves hinged together along an axis transverse to the longitudinal axis of the blank and adapted to form a hinged carton, the hinge axis separating the two halves, each half having a central panel surrounded by hingable side forming and end forming panels, the hinge axis joining an end panel of each half, said hinge axis joined end panels being of substantially the same width, the side panels of one half being of equal width, the side panels of the other half being of equal width, but being of a greater width than the first mentioned equal width side panels, the end panel remote from the hinge axis of that half having the lesser width side panels being of a lesser width than the width of the end panel remote from the hinge axis of that half having the greater width side panels, and wherein those side panels of one of the halves which are of greater width are provided with hinged, laterally extending wiping panels adapted to fold inwardly of the mouth of that tray having the greater width side panels.

6. The one piece blank of claim 5 including means at each longitudinal end of the blank for latching the two halves together when the blank is folded and erected to form a hinged carton defined by two hinged trays.

7. The one piece of claim 5 wherein the end panel, remote from the hinge axis, of that half having the greater width side panels is provided with a hinged flap.

* * * * *